US007953342B2

(12) United States Patent
Nakamura et al.

(10) Patent No.: US 7,953,342 B2
(45) Date of Patent: May 31, 2011

(54) IMAGE FORMING APPARATUS

(75) Inventors: Masakazu Nakamura, Hino (JP); Masami Maruko, Hachioji (JP); Kazunori Katada, Hino (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 151 days.

(21) Appl. No.: 12/364,639

(22) Filed: Feb. 3, 2009

(65) Prior Publication Data

US 2009/0202267 A1 Aug. 13, 2009

(30) Foreign Application Priority Data

Feb. 8, 2008 (JP) ..... 2008-028569

(51) Int. Cl.
*G03G 21/20* (2006.01)

(52) U.S. Cl. ..... 399/92

(58) Field of Classification Search ..... 399/33, 399/92, 94, 101
See application file for complete search history.

(56) References Cited

U.S. PATENT DOCUMENTS

| | | | | |
|---|---|---|---|---|
| 5,138,375 | A * | 8/1992 | Iimori | 399/92 |
| 5,307,132 | A * | 4/1994 | Tsuchiya | 399/92 X |
| 5,479,242 | A * | 12/1995 | Sato et al. | 399/92 |
| 5,550,621 | A * | 8/1996 | Ogawahara | 399/92 X |
| 5,787,321 | A * | 7/1998 | Nishikawa et al. | 399/92 X |
| 6,253,042 | B1 | 6/2001 | Yang | |
| 6,580,884 | B2 * | 6/2003 | Kuwabara | 399/92 |
| 6,865,361 | B2 * | 3/2005 | Abe et al. | 399/101 X |
| 7,113,723 | B2 * | 9/2006 | Saito | 399/101 |
| 7,308,219 | B2 * | 12/2007 | Shishido | 399/92 |
| 2006/0051124 | A1 | 3/2006 | Oka | |
| 2006/0083539 | A1 | 4/2006 | Nishikawa | |
| 2006/0291894 | A1 * | 12/2006 | Chung et al. | 399/92 |
| 2007/0110471 | A1 | 5/2007 | Kitamura | |
| 2007/0196119 | A1 * | 8/2007 | Fujita | 399/92 X |

FOREIGN PATENT DOCUMENTS

| | | |
|---|---|---|
| JP | 04-340577 | 11/1992 |
| JP | 07-129065 | 5/1995 |
| JP | 7-181874 | 7/1995 |

OTHER PUBLICATIONS

European Search Report in corresponding Application No. 09151490.1-2209 dated Jul. 15, 2009.

* cited by examiner

*Primary Examiner* — Sandra L Brase
(74) *Attorney, Agent, or Firm* — Buchanan Ingersoll & Rooney PC

(57) ABSTRACT

An image forming apparatus, having: an image carrier to carry a toner image; a transfer unit to transfer the toner image on the image carrier onto a sheet through a rotating member disposed to face the image carrier; a fixing unit to heat and fix the transferred toner image onto the sheet; and a cooling device to suctions air from a transfer unit side and discharge the air to a fixing unit side.

12 Claims, 4 Drawing Sheets

IMAGE FORMING APPARATUS

This application is based on Japanese Patent Application No. 2008-028569 filed on Feb. 8, 2008 in Japanese Patent Office, the entire content of which is hereby incorporated by reference.

BACKGROUND OF THE INVENTION

The present invention relates to an image forming apparatus such as a copying machine, a printer, and a facsimile machine using electrophotographic method.

In recent years, image forming apparatuses such as copying machines, printers, and facsimile machines using electrophotographic method are used in various fields.

Most of the above image forming apparatuses are provided with fixing units to melt and fix a toner image onto a sheet by heat.

Such fixing units carries out a fixing process through a nip section configured with rollers or belts arranged to face one another by heat while conveying the sheet carrying the toner image thereon.

A countermeasure to prevent the fixing unit having a heating section and a vicinity thereof from heating are needed, since the heating unit is subject to high temperature.

As the countermeasures to prevent the fixing unit from heating, for example, there is suggested to provide a ventilation flue to supply cool air and to control the air by turning on and off a fan (for example refer to Patent document 1: Unexamined Japanese Patent Application Publication No. H7-181874).

However, it is difficult to completely prevent air inside the image forming apparatus from rising in temperature due to heat generated by the fixing unit or to prevent each device related to image forming provided in the apparatus from rising in temperature.

The above problem is a serious problem for a high speed image forming apparatus used for a consecutive long-haul image forming job.

There is publicly known a high speed image forming apparatus having a transfer unit to transfer a toner image, formed on an image carrier such as a photoconductive member or intermediate transfer member, onto the sheet through a transfer roller or a transfer belt disposed to face the image carrier.

When temperature of the transfer unit is raised by the heat propagated from the fixing unit, temperature of the image carrier in direct contact with the transfer unit raises immediately and eventually, temperature of developer and a development device is raised which results in deterioration of image quality.

Also, the transfer unit used for a high speed image forming apparatus is often provided with a transfer cleaning section to remove toner adhered on the transfer roller or the transfer belt.

When the temperature of the transfer cleaning section raises, packing of waste toner occurs.

To prevent occurrence of the above problems, a cooling device becomes necessary to suppress raise in temperature of the transfer units, however such countermeasure tends to increase cost.

Patent Document: Unexamined Japanese Patent Application Publication No. H7-181874

In view of the above problems, an object of the present invention is to realize the cooling device to effectively suppress raise in temperature of the transfer unit of the image forming apparatus and excessive raise in temperature of the fixing unit without the cost being raised.

SUMMARY OF THE INVENTION

The above problem can be solved by the following. An image forming apparatus, having: an image carrier to carry a toner image; a transfer unit to transfer the toner image on the image carrier onto a sheet through a rotating member disposed to face the image carrier; a fixing unit to heat and fix the transferred toner image onto the sheet; and a cooling device to suction air from a transfer unit side and discharge the air to a fixing unit side.

DETAILED DESCRIPTION OF THE PREFERRED EMBODIMENT

An embodiment of the present invention will be described with reference to the drawings.

Figure 1:
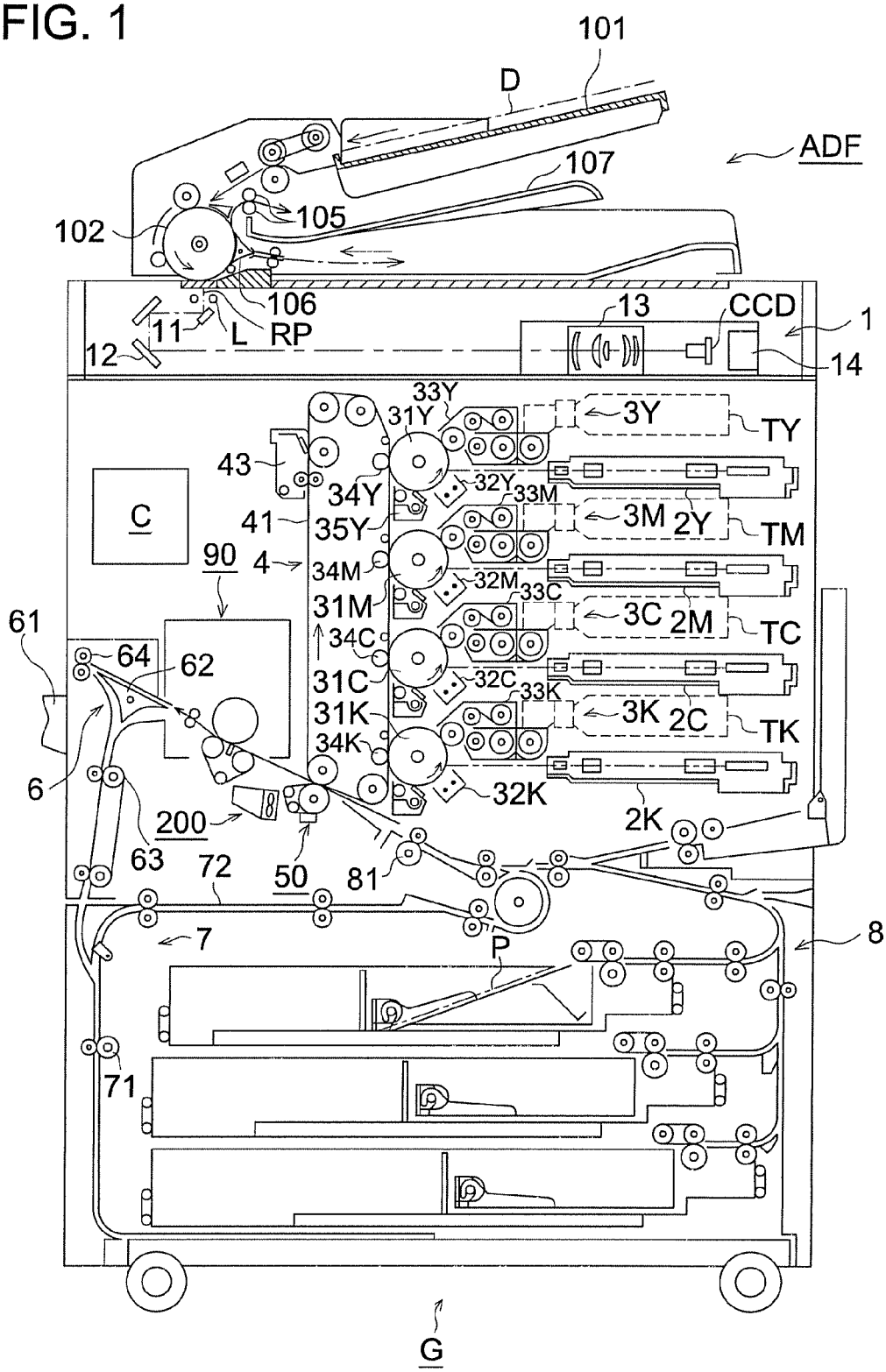
FIG. 1 is a schematic diagram of an image forming apparatus.

FIG. 1 is a schematic diagram of a typical image forming apparatus G to produce a color copy.

The image forming apparatus G shown in the figure is so-called a tandem type color image forming apparatus to form a full color image wherein a plurality of photoconductive members 31Y, 31M, 31C and 31K are arranged longitudinally in an array facing one intermediate transfer belt 41.

The image forming apparatus G is provided with an automatic document feeding apparatus ADF at an upper part thereof.

A document D placed on a document table 101 of the automatic document feeding apparatus ADF is separated piece by piece and sent to a document conveyance path and conveyed through a conveyance drum 102.

An image on the document D is read while conveying through a document reading section 1 at a document image reading position RP. The document D having been read is ejected to a document ejection table 107 through a first conveyance guide 106 and document ejection rollers 105.

Image forming apparatus G is configured with document reading section 1, exposing sections 2Y, 2M, 2C and 2K, image forming sections 3Y, 3M, 3C and 3K, an intermediate transfer section 4, a fixing unit 90, a reversal sheet ejection section 6, a sheet re-feeding section 7, a sheet feeding section 8, and a control section C, which are stored in a housing.

In the document reading section 1, the image of the document is irradiated through a lamp L at the document reading position RP and the reflected light is lead through a first mirror unit 11, a second mirror unit 12 and a lens 13 so that an image is formed on a light receiving surface of an imaging element CCD.

The image signal converted through photoelectric conversion by the imaging element CCD is subject to processing such as A/D conversion, shading correction and compression in the image reading control section 14 and stored in a memory of the control section C as image data.

In the image data stored in the memory of the control section C is subject to image processing with conditions set by a user so as to create output image data.

Each of exposing sections 2Y, 2M, 2C and 2K is configured with a laser light source, a polygonal mirror, and a plurality of lenses to form a laser beam.

The exposing sections 2Y, 2M, 2C and 2K carry out exposure scanning on surfaces of the photoconductive members 31Y, 31M, 31C and 31K representing components of the image forming sections 3Y, 3M, 3C and 2K with the laser beam in accordance with output information outputted based on the output image data sent from the control section C.

On the photoconductive members 31Y, 31M, 31C and 31K, latent images are formed through exposure scanning of the laser beam.

The image forming section 3Y is configured with a photoconductive member 31Y, and a main charging section 32Y, a developing section 33Y, a first transfer roller 34Y and a cleaning section 35Y disposed at a vicinity thereof.

Also, the image forming sections of respective colors are provided with toner supply sections to supply toner from toner bottles TY, TM, TC and TK to the developing sections 33Y, 33M, 33C and 33K.

The latent images formed on the photoconductive members 31Y, 31M, 31C and 31K through exposure scanning of the laser beam are developed through the corresponding developing sections 33Y, 33M, 33C and 33K, thus toner images are formed on respective photoconductive members.

The intermediate transfer section 4 is configured with an intermediate transfer belt 41, first transfer rollers 34Y, 34M, 34C and 34K, a transfer unit 50 and a belt cleaning section 43.

The toner images formed on the photoconductive members 31Y, 31M, 31C and 31K are subsequently transferred on a predetermined position on the intermediate transfer belt 41 representing an image carrier, usually called an intermediate transfer member, through the first rollers 34Y, 34M, 34C and 34K of the intermediate transfer section 4.

Meanwhile, after transferring the toner image, the cleaning section 32Y, 32M, 32C and 32K remove the residual toner from the surface of the photoconductive members.

On other hand, the toner image transferred onto the intermediate transfer belt 41 is transferred through a transfer unit 50 onto a sheet P representing a transfer material fed from a sheet feeding section 8 through sheet feeding roller 81 which conducts sheet feeding timing.

After transferring the toner image onto the sheet P, the surface of the intermediate transfer belt 41 is cleaned through the belt cleaning section 43 and served for subsequent image transfer.

On the other hand, the transferred sheet P carrying the toner image thereon is sent to the fixing unit 90, thus the toner image is fixed onto the sheet P through pressure heating.

The sheet P having been fixed through the fixed unit 90 is conveyed through an ejection sheet reversal section 6 and ejected to an ejection sheet table 61. In case the sheet P is reversed to be ejected, the ejection sheet guide 62 leads the sheet P downwards once, then after a rear of the sheet P is grasped by ejection sheet reversal roller 63, the sheet P is reversed, and an ejection sheet guide 62 leads the sheet P to ejection sheet roller 64 to eject the sheet.

Meanwhile, in case the image is formed on the reverse side of the sheet P as well, after image fixing on the obverse side of the sheet P is completed, the ejection sheet guide 62 leads the sheet P to the sheet re-feeding section 7 on the lower side. Then a sheet re-feeding reversal roller 71 grasps the rear end of the sheet P, thereafter the sheet is reversed by reverse sending and sent out to a sheet re-feeding conveyance path 72 to be served for image forming on the reverse surface.

Figure 2:
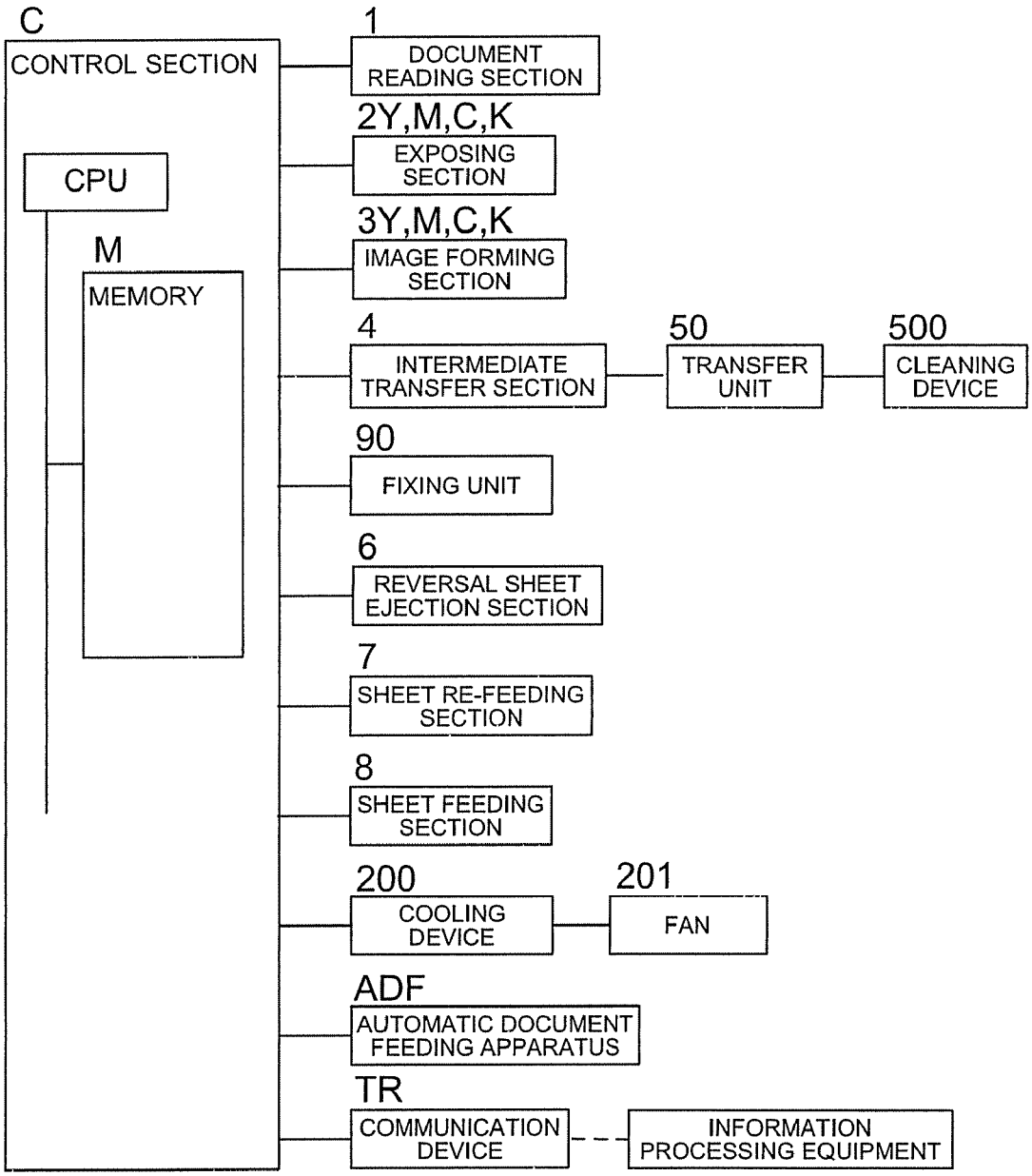
FIG. 2 is a block diagram showing control of the image forming apparatus.

FIG. 2 is a block diagram showing control of the image forming apparatus G.

The control section C is a computer system having a CPU, a memory, a calculation unit, an I/O port, a communication interface and a driving circuit.

The control section C carries out control by executing a predetermined program stored in a memory M.

Also the control section C exchanges information between a plurality of information processing devices via the communication device TR.

Meanwhile, in the present figure, portions not related to the description of the present invention are omitted.

Figure 3:
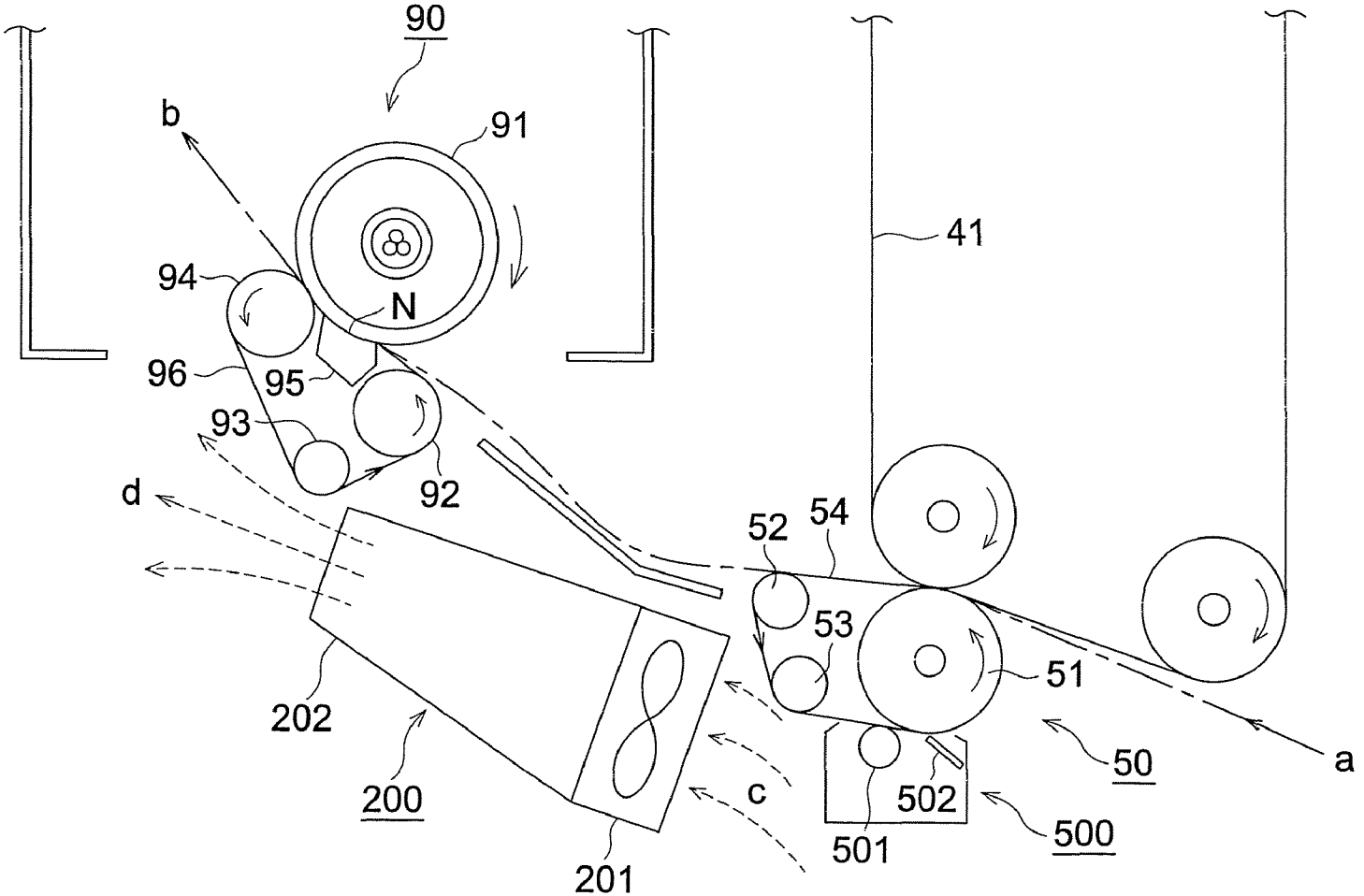
FIG. 3 is a schematic diagram describing a cooling device.

FIG. 3 is a schematic diagram to describe a cooling device 200.

The sheet P sent from the sheet feeding rollers 81 enters from a direction of an arrow a shown by dashed lines and the transfer unit 50 transfers a toner image on the intermediate transfer belt 41 representing an image carrier onto the sheet P, then the fixing unit 90 fixes the toner image, thereafter the sheet P is sent in a direction of an arrow b.

The transfer unit 50 is configured with rollers 51, 52 and 53, a belt 54 representing a rotating member, and a cleaning device 500. The belt 54 is trained about the rollers 51, 52 and 53, and disposed to face the intermediate transfer belt 41 representing an image carrier.

The cleaning device 500 is provided with a rotation brush 501 and a blade 502 to remove extraneous matters such as toner adhering on a circumferential surface of the belt.

Fixing unit 90 is a publicly known fixing device configured with a heating roller 91, rollers 92, 93 94 and 95, an urging member 95, and a fixing belt 96 training about a plurality of the rollers thereof and the urging member 95.

A cooling device 200 is configured with a plurality of fans 201 arrayed in a depth direction in the figure, namely in a direction perpendicular to the traveling direction of the sheet P and controlled by the control section C in rotation speed thereof, and a duct 202 to lead air sent from the fans 201 to a specific direction.

As FIG. 3 shows, the cooling device 200, disposed between the transfer unit 50 and the fixing unit 90, suctions air at a vicinity of the transfer unit 50 and sends below the fixing unit 90 as a broken arrows c and d show.

The transfer unit 50 is prevented from temperature increase through air flow at vicinities of the transfer unit 50 and in particular vicinities of cleaning unit 500, generated by suction of the cooling device 90.

The air having cooled the transfer unit 50 is led through the duct 202 and discharged, then flows on the surface of the fixing belt 96 which is in a high temperature.

Such air flow prevents the fixing belt 96 from excessive temperature increase and suppresses temperature increase of the transfer unit 50, since air flow of the air heated by heat generation of the fixing unit 90 towards the transfer unit 50 is prevented.

Meanwhile, the cooling device 200 sends air in a way that the air flows on the circumferential surface of the belt located at an opposite side of a nip section N configured with the heating roller 91 of the fixing unit 90 and a fixing belt 96, therefore the air flow cannot be a factor to bother travel of the sheet P towards the nip section N.

As described in the forgoing, the plurality of the fans 201 are controlled by the control section C in rotation speed. In accordance with operation conditions of the image forming apparatus G the rotation speed and on/off timing are controlled.

For example, the fan 201 is stopped or the rotation speed thereof is reduced during warming up of the apparatus or when the operation has been stopped for a certain period of time.

The above control is determined at the design phase.

As above, while the present invention has been described with reference to the color image forming apparatus having the intermediate transfer belt 41 as the image carrier, the same effect as the present invention can be expected in image forming apparatuses not having the intermediate transfer belt 41.

Figure 4:
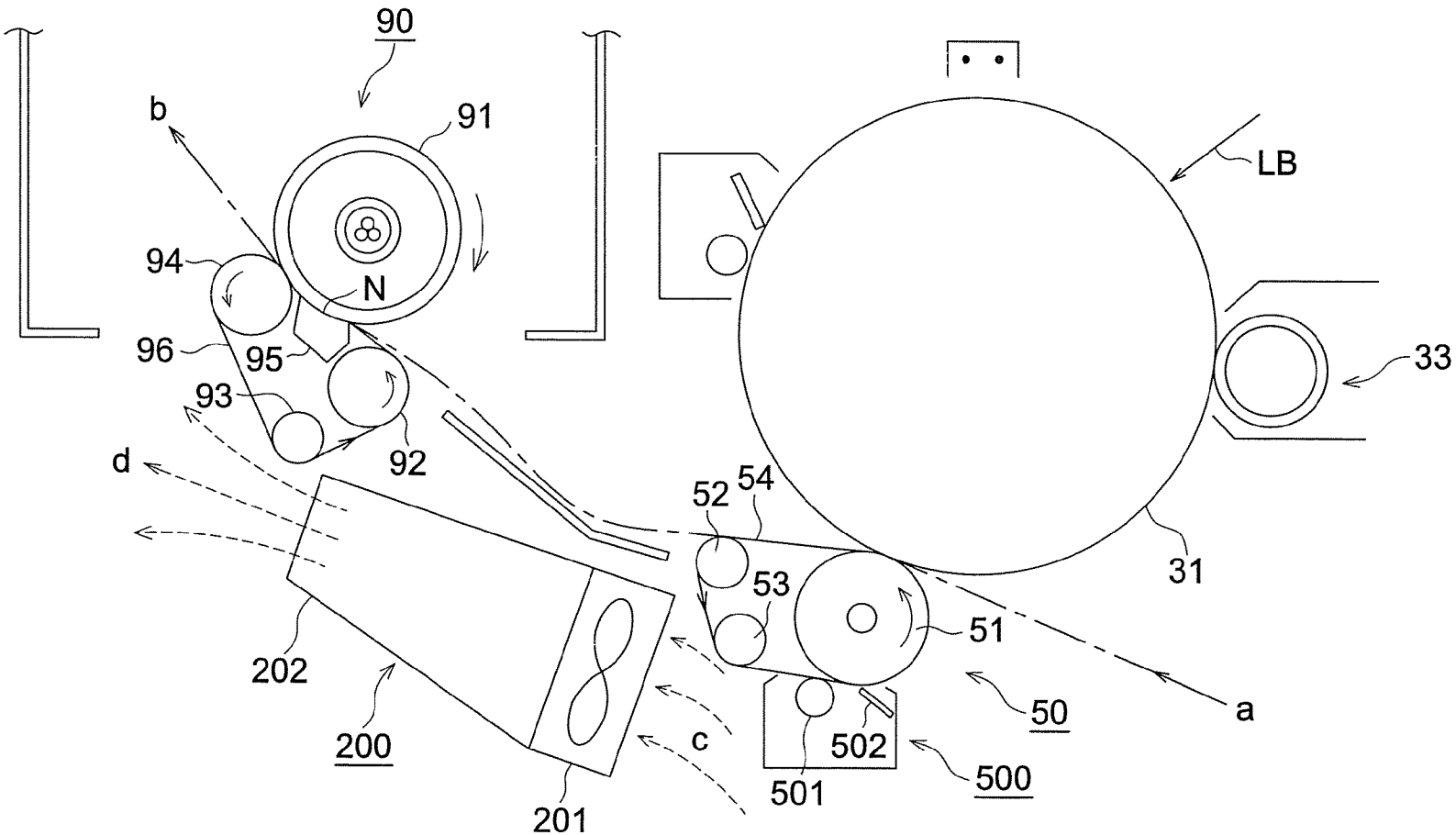
FIG. 4 is a diagram describing an exemplary application for a common monochrome image forming apparatus.

FIG. 4 is a diagram describing an exemplary application for a common monochrome image forming apparatus.

FIG. 4 shows a portion of image forming apparatus where a laser beam LB forms a latent image on the photoconductive drum 31, a developing section 33 carries out toner developing, and a transfer unit 50 transfers the toner image on the photoconductive drum 31 representing an image carrier onto a sheet traveling in a direction of an arrow a.

As above, the cooling device 200 of the present invention can be applied to an image carrier disposed to face the transfer unit 50 irrespective of whether the image carrier represents a photoconductive member or an intermediate transfer member.

Also, the present invention can be applied to the image carrier irrespective of whether the image carrier is a drum or a belt.

As described in foregoing, by providing the cooling device of the present invention, temperature increase of the transfer unit and excessive temperature increase of the fixing unit can be suppressed without increasing cost.

What is claimed is:

1. An image forming apparatus, comprising:

an image carrier to carry a toner image;

a transfer unit to transfer the toner image on the image carrier onto a surface of a sheet through a rotating member disposed to face the image carrier;

a fixing unit to heat and fix the transferred toner image onto the sheet; and a cooling device to suction air from a transfer unit side and discharge the air to a fixing unit side, wherein the cooling device is disposed between the transfer unit and the fixing unit on an opposite side of the sheet from the surface on which the transferred toner image exists before fixing.

2. The image forming apparatus of claim 1, further comprising a cleaning device to remove extraneous matters adhering on a circumferential surface of the rotating member.

3. The image forming apparatus of claim 1, wherein the fixing unit, having a first member and a second member facing one another to rotate, conveys the sheet grasped by a nip section configured with the first member and the second member while heating the sheet, the first member is disposed at a contact side to the toner image transferred on the sheet being conveyed and the cooling device discharges air towards a circumferential surface of the second member at an opposite side of the nip section.

4. The image forming apparatus of claim 1, where the cooling device is provided with a plurality of fans arrayed in a straight line perpendicular to a conveyance direction of the sheet.

5. The image forming apparatus of claim 1, further comprising a control section to control air volume of air discharged from the cooling device.

6. The image forming apparatus of claim 5, comprising a fan, wherein the control section controls rotation speed of the fan.

7. The image forming apparatus of claim 6, wherein the control section stops the fan while the image forming apparatus is in warm-up operation.

8. The image forming apparatus of claim 6, wherein the control section stops the fan when the image forming apparatus ceases operation for more than a certain period of time.

9. The image forming apparatus of claim 6, wherein the control section reduces the rotation speed of the fan while the image forming apparatus is in warm-up operation.

10. The image forming apparatus of claim 6, wherein the control section reduces the rotation speed of the fan when the image forming apparatus ceases operation for more than a certain period of time.

11. The image forming apparatus of claim 1, wherein the rotation member is a transfer belt.

12. The image forming apparatus of claim 1, wherein the cooling unit has a duct through which air flows from the transfer unit to the fixing unit.

* * * * *